US006072065A

United States Patent [19]

Chavet

[11] Patent Number: 6,072,065

[45] Date of Patent: Jun. 6, 2000

[54] ALKALINE TREATMENT METHOD FOR REFINING USED OILS

[76] Inventor: Bernard Chavet, Le Hennetot 27210, Beuzeville, France

[21] Appl. No.: 08/981,749

[22] PCT Filed: Jun. 21, 1996

[86] PCT No.: PCT/FR96/00974

§ 371 Date: Apr. 20, 1998

§ 102(e) Date: Apr. 20, 1998

[87] PCT Pub. No.: WO97/00928

PCT Pub. Date: Jan. 9, 1997

[30] Foreign Application Priority Data

Jun. 22, 1995 [FR] France ..... 95 07484

[51] Int. Cl.[7] ..... C11B 3/12

[52] U.S. Cl. ..... 554/195; 554/202; 208/180

[58] Field of Search ..... 554/195, 202; 208/180

[56] References Cited

U.S. PATENT DOCUMENTS

| | | | |
|---|---|---|---|
| 3,625,881 | 12/1971 | Chambers . | |
| 4,097,369 | 6/1978 | Ebel et al. | 208/180 |

FOREIGN PATENT DOCUMENTS

| | | |
|---|---|---|
| 0099951 | 2/1984 | European Pat. Off. . |
| 2152821 | 4/1973 | France . |
| 2302335 | 9/1976 | France . |
| 2552098 | 3/1985 | France . |
| 1594531 | 7/1970 | Germany . |
| 1041703 | 9/1966 | United Kingdom . |
| 9323506 | 11/1993 | WIPO . |

*Primary Examiner*—Deborah D. Carr
*Attorney, Agent, or Firm*—Nixon & Vanderhye P.C.

[57] ABSTRACT

An alkaline treatment method for refining used oils, wherein (a) the used oils are distilled; (b) the resulting distillate is treated with an alkaline agent in the presence of a solvent selected from water, a monoalcohol, a polyalcohol and a mixture of said a alcohols, said alkaline agent being present in a percentage by weight, based on the weight of the distillate, equal to the product F×(IA+IS), where F is a multiplier between 2 and 50 and IA and IS are the acid value and the saponification value respectively of said distillate, at a temperatue of around 80–330° C. for 2–200 minutes; (c) the reaction medium is washed with water then decanted to recover the oily phase; and (d) said oily phase is distilled. The method is useful for producing refined oils having excellent properties in that they are odorless and nearly colorless and in that they have a very low chlorine, phosphorus and sillicon content.

15 Claims, No Drawings

ALKALINE TREATMENT METHOD FOR REFINING USED OILS

This application is a 371 of PCT/ER96/00974 filed Jun. 21, 1996.

The present invention relates to a process for refining used oils leading to refined oil products which can be re-used as base oils, fuel oils, or in an oil refinery.

According to the present application, the expression <<used oils>> designates an oil or a mixture of oils in variable proportions originating from various origins in particular from industrial applications.

As this is well known, industrial or engine lubricant oils contain various additives used to provide the required specific characteristics for the contemplated applications. These additives are either organic (known as <<ashless additives>>) or organometallic. Apart from their specific feature (e.g. anti-corrosion, anti-wear, anti-oxidant, dispersant . . . ) they are all characterized by an excellent solubility in base oils (hydrocarbons with boiling points above 350° C.) a thermal stability as high as possible and a volatility as low as possible.

The lubricants which are discarded or used oils contain as impurities such additives either intact or under the form of decomposed by-products, as well as sediments (wear particles from moving parts, airborne particles, carbon . . . ) and hydrocarbons which were not present in the original lubricant and which are undesirable. The latter are essentially gasoline and gas—oil fractions, oxidation products (e.g. organic acids) and pyrolysis products. The presence of these various impurities is rendering particularly difficult the refining of used oils.

In general, industrial used oils as above defined exhibit the typical characteristics given in the following Table 1:

TABLE 1

| | |
|---|---|
| Chlorine content (mg/kg) | 150–2000 |
| Phosphorus content (mg/kg) | 300–1300 |
| Silicon content (mg/kg) | 8–80 |
| Colour (ASTM D 1500) | >8 |
| Odour (sensorial evaluation) | very strong |
| Water content (wt %) | 0.2–1.2 |
| Sediments (wt %) | 0.1–0.5 |
| Viscosity at 40° C. ($mm^2/s$) | 35–140 |
| Total Acid Number (TAN, mg KOH/g) | 0.9–4.5 |
| Saponification Number (SN, mg KOH/g) | 4–17 |

In Table 1 above, the phosphorus and silicon contents were determined by plasma, the chlorine contents either by X-Fluorescence (above 50 mg/kg) or coulometry (below 50 mg/kg), the Total Acid Number through the NFT 60112 French standard, the viscosity at 40° C. through the NFT 60110 standard, the color through the ASTMD 1500 standard; the odour was tested by sensorial evaluation of the operator and the Saponification Number was determined by potentiometry.

In order to separate the various contaminants from used oils and especially to improve their colour and odour, several physical and/or chemical separation methods as well as refining processes have been developed in order to reclaim them and use them as base oils, fuel oils or in an oil refinery.

When a base oil application is contemplated the colour must be very low (at least below 4 according to the ASTM D 1500 standard).

When a combustible application is considered, such as in industrial heating systems, they must be odour free and exhibit a low residual acidity (i.e. TAN below 0.2 mg KOH/g) and a low chlorine content, a potential source of atmospheric pollutants.

Last, when they are to be treated in oil refineries (catalytic cracking or hydrogenation) their phosphorus, silicon and chlorine contents must be very low to avoid catalyst poisoning or destruction (i.e. more specifically a phosphorus content of less than 5 mg/kg, a chlorine content below 35 mg/kg) and a silicon content of less than 5 mg/kg).

Among the known physical separation methods for treating used oils, it can be cited vacuum distillation, solvent precipitation with a solvent such as propane or "deasphalting" and ultra filtration. They all show a significant effectiveness to remove sediments and, to a certain extent demetallize or clarify used oils. However such physical methods do not enable to remove all the impurities in the used oils. Thus, for example, distilled fractions still have a very strong odour, a significant acidity and do contain unacceptable proportions of volatil compounds, chlorine, phosphorus and silicon.

Among the known chemical separation methods for treating used oils; it can be mentioned the methods involving an alkaline agent. However, most of these processes, are aiming to facilitate the coagulation and subsequently the separation of the sediments, and are essentially designed to protect the behaviour of the equipment (distillation, and heat exchangers by reducing the fouling). Here again, the resulting oil products are inadequate to be used as base oils to formulate new lubricants. Thus, for example alkaline treatments applied to used oils prior to their vacuum distillation, although they do reduce odour and acidity of the resulting oils, do not quantitatively remove undesirable contaminants such as chlorine, in view of the operating conditions in which the alkaline agents are used. The used oils, pretreated through one of the above mentioned processes can be further refined by high pressure catalytic hydrogenation, by concentrated sulfuric acid treatment, by activated clay contacting or by combining the last two treatments, and in some cases by a distillation after one of these treatments.

High pressure catalytic hydrogenation cannot however, be performed without a rapid catalyst deactivation if the processed oils are not essentially free of contaminants like phosphorus, chlorine and silicone. Other processes of treatment involving sulfuric acid and/or activated clay generate acidic sludges and used clay which are raising disposal problems.

The known used oils refining processes do not adequately perform or raise by-products disposal problems. There was therefore a chlorine and silicone. Other processes of treatment involving sulfuric acid and/or activated clay generate acidic sludges and used clay which are raising disposal problems.

As the state of the art as above mentioned it can be cited the following patents:

FR-A-2552098 which discloses a retreatment process of used oils comprising the steps to eliminate water and the volatil constituents, then carrying out an alkaline treatment prior to the total vacuum distillation during which the tarry fraction is separated.

FR-A-2302335 discloses a process for the treatment of used mineral oils wherein an "intense purification" of the oil to be treated is carried out prior to hydrogenation step as the final step of the process.

FR-A-2152821 discloses a process for regenerating non-aqueous lubricant used for metal working (for example cold rolling) which comprises the step to contact the lubricant with an alkaline hydroxyde in the presence of an aliphatic monoalcohol, this step being preferably followed by a mechanical separation to eliminate the resulting precipitate for example by filtration or centrifugation.

The known used oils refining processes do not adequately perform or raise by-products disposal problems. There was therefore a real need for the development of a process leading, in a simple and economical way, to refined oils presenting the all desired properties and thus characteristics.

The subject of the present invention is thus an used oils refining process giving rise to refined oils meeting the various quality and purity requirements, this process being characterized by the following sequence of well-determined steps consisting in:

a) carrying out the distillation of the used oils, b) contacting the resulting distillate with an alkaline reactant in the presence of a solvent selected from water, monoalcohols, polyalcohols and a mixture thereof, the proportion of the alkaline reactant used being, in weight % to the weight of the distillate, equal to F×(TAN+SN), F being a multiplying factor between 2 and 50, TAN and SN being respectively the Total Acid Number and the Saponification Number, the contacting treatment being carried out at a temperature between 80° C. and 330° C. for a time between 2 and 200 minutes, c) washing the reaction medium with water followed by settling to recover the oil phase, and d) carrying out a distillation of the above oil phase.

The process according to the present invention is very versatile as it can be adapted, concerning its operative conditions, to the quality requirements of the finished products. More specifically, the process according to the invention can be applied subsequently to one of the physical and/or chemical separation methods or prior to any of the refining processes, mentioned above.

According to a specific embodiment of the process according to the invention the distillation step (a) is first performed under atmospheric pressure, at a temperature comprised between about 130° C. and 180° C. to remove water and the heavy gasoline fractions. This distillation is subsequently performed under a reduced pressure of about 650 to 12000 Pa, and at a temperature comprised between about 240° C. and 345° C. to recover a small quantity of gas-oil fraction and a much larger amount of vacuum distillate, corresponding to more than 60% of the starting used oils. Although the whole distillate can be processed in step (b) described above, it is preferable according to the invention to use only the major fraction of the distillate.

The above preliminary distillation step is of special importance as it enables to separate the near total amount of the tarry material.

The alkaline reactant used in step (b) of the process is either sodium hydroxide or potassium hydroxide but never a mixture of both. Preferably, according to the invention, potassium hydroxide is used. Owing to the proportion of alkaline reactant added above mentioned, the pH of the reacting medium (distillate+alkaline solution) is above 8 and preferably between 9.5 and 13.

When the solvent used in step (b) is water, then the alkaline reactant concentration in the aqueous solution is preferably between 50 and 96% wt. A particularly attractive aqueous solution of the alkaline reactant is the potassium hydroxide/water eutectic combination (86.7/13.3).

The aqueous alkaline solution is first prepared and then added under permanent agitation to the distillate obtained in step (a). This solution can be "solid" at ambient temperature as it is the case of the potassium hydroxide/water eutectic (86.7/13.3) which is the preferred reactant. In that case, the solution "solid" turns into a low viscosity liquid at reaction temperature.

When the solvent used in step (b) is a monoalcohol, a polyalcohol or a mixture thereof, the alcoholic solution used is preferably such that the mole ratio solvent/alkaline reactant is between 2 and 20 and more specifically between 2.5 and 5.

According to a preferred embodiment of the invention, the quantity of alcohol or mixture of alcohols used must be sufficient to warrant in the reacting medium an alkaline reactant concentration close to saturation.

The monoalcohol or polyalcohol preferably contains 2 to 8 carbon atoms and more specifically 2 to 5.

Among the preferred monoalcohols according to the invention, the following can be mentioned: ethanol, n-propanol, isopropanol, n-butanol, sec-butanol, tert-butanol, isobutanol, pentanols, hexanols and octanols. Among the preferred polyalcohols according to the invention, the following can be mentioned: ethyleneglycol di- or tri-ethyleneglycol. According to the invention, it is preferable to select alcohols with a boiling point lower than the initial boiling point of the distillate being processed, and/or being highly water soluble, this making easier their further separation by water washing or distillation.

The reacting medium is preferably prepared either by dissolving the alkaline reactant into the alcohol, then injecting this solution into the distillate to be processed or by mixing the hot distillate with the alcohol and then adding the alkaline reactant in the form of solid pellets.

According to a more specific embodiment of step (b) of the process according to the invention, when using as solvent an alcohol or a mixture of alcohols, the alkaline treatment of the distillate is performed at alcohol reflux provided evaporation losses can be avoided.

According to an other specific embodiment of step (b) of the process according to the invention, when the reaction temperature is high, and especially when the solvent includes an alcohol with a normal boiling point inferior to the selected reaction temperature, the alkaline treatment of the distillate with the alkaline reactant is performed under a pressure between $10^5$ and $50\times10^5$ Pa, preferably between $10^5$ and $25\times10^5$ Pa in order to avoid evaporation losses.

After completion of the alkaline treatment, the reacting medium is washed at least once with about 1 to 15% water at a temperature between ambient temperature and 100° C. This water washing operation or step (c) of the process according to the invention is essential to remove any alkaline reactant in excess, the alcohol if used as a solvent and all water soluble by-products resulting from the alkaline reacted contaminants.

When the water washing operation is performed, only once, it normally uses 10% water at a temperature of about 100° C.

However, according to a most preferred embodiment, the water washing operation is performed in two successive steps. The first one involves washing the reacting medium from step (b) with about 1 to 10% water and at a temperature as low as possible, between 20° C. and 90° C. The second one consists, after settling, in washing again the reacted medium with 1% to 10% water at a temperature as high as possible and at least identical to that of the first water washing operation.

With respect to the first washing operation, the temperature must preferably be as low as possible in order to minimize hydrolysis but sufficient to lower the viscosity of the reacted medium from step (b) and warrant sufficient settleability.

By contrast, the temperature for the second washing operation must be as high as possible in order to perform a thorough elimination of the residual alkaline reactant.

The total amount of water involved in this specific embodiment is preferably between 5 and 15%.

According to a variante of this two steps water washing operation, the second washing step can be performed with a weak acidic aqueous solution such as hydrochloric acid between 0.1 and 1 N.

After the washing and settling steps, the oil phase is subjected to the distillation step (d), firstly at atmospheric pressure and at a temperature between 70° C. and 270° C. to eliminate the last traces of solvent and next under vacuum at a pressure between 650 Pa and 1350 Pa and at a temperature between 210° C. and 375° C., this leading to a refined oil and a residue which amounts to less than 5% of the initial oil phase prior to distillation.

According to a variante of the process of the invention, the water washing step (c) of the oil phase can be followed by at least one of the following treatments: high pressure catalytic hydrogenation, reaction with a sulfonating agent and/or activated carbon or clay contacting.

The sulfonating agent is preferably either concentrated sulfuric acid or chlorosulfonic acid.

The activated clay is preferably a mineral clay of the silicoaluminate type which has been activated by acid treatment.

When the oil phase is reacted with a sulfonating agent, this treatment is preferably followed by a neutralization of the oil phase, the neutralizing agent being either the water from step (c) or preferably by addition of an aqueous ammonia solution.

The refined oil or base oil produced according to the process of the invention exhibits excellent physical and chemical characteristics. It is odour free, slightly coloured with very low chlorine, phosphorus and silicon contents.

The main characteristics of the refined oils produced according to the process of the invention are summarized below.

TABLE II

| | |
|---|---|
| Chlorine content (mg/kg) | <35 |
| Phosphorus content (mg/kg) | <5 |
| Silicon content (mg/kg) | <5 |
| Colour (ASTM D 1500) | <3 |
| Odour (sensorial evaluation) | Very slight |
| Water content (wt %) | <0.01 |
| Sediments (wt %) | None |
| Viscosity at 40° C. ($mm^2/s$) | <85 |
| Total Acid Number (TAN, mg KOH/g) | <0.05 |
| Saponification Number (SN, mg KOH/g) | <0.20 |

Comparison between Tables I and II clearly demonstrates the efficiency of the process according to the invention especially with respect to the reduction of the major contaminants of used oils.

The following examples will better illustrate the application of the process according to the invention, based on used oils having the characteristics shown on Table I.

EXAMPLES 1 AND 2

From used oils of various industrial origins a distillation was first performed under atmospheric pressure, then after raising the temperature, under a pressure of about 1350 Pa, leading to the following fractions.

TABLE III

| Fraction | Pressure (Pa) | Temperature (° C.) | Proportion (wt %) |
|---|---|---|---|
| 1 | $1.013 \times 10^5$ | 130/180 | 7.5% ($H_2O$ + gasoline) |
| 2 | 5300/10700 | 240/285 | 9% (gas-oil) |
| 3 | 650/2000 | 285/345 | 65% |

The residue was approximately 18.5 wt % and was essentially tarry products.

The major fraction (65 wt % of the total) had the following characteristics:

TABLE IV

| | |
|---|---|
| Chlorine content (mg/kg) | 60 |
| Phosphorus content (mg/kg) | 27 |
| Silicon content (mg/kg) | 9 |
| Colour (ASTM D 1500) | 6.5 |
| Odour (sensorial evaluation) | very strong |
| Water content (wt %) | <80 |
| Sediments (wt %) | None |
| Viscosity at 40° C. ($mm^2/s$) | 31.24 |
| Total Acid Number (TAN, mg KOH/g) | 0.26 |
| Saponification Number (SN, mg KOH/g) | 1.30 |

A part of the distillate representing 65% was processed under the conditions shown on Table V with a 50 wt % potassium hydroxide solution, at 300° C. and $14 \times 10^5$ Pa pressure. Another part of the same distillate was processed with the potassium hydroxide/water eutectic (86.7/13.3), at 220° C. and $10^5$ Pa pressure. Following the alkaline treatment, the reacted medium was washed several times with water at about 90° C. in order to remove the excess of the alkaline reactant and the various water soluble by-products resulting from the alkaline treatment.

After settling and separation, the oil phase was distilled under atmospheric pressure first, then under vacuum comprised between 650 and 1350 Pa. 96% of the initial distillate was thus recovered.

The key characteristics of the two refined oils are also shown on Table V, from which it is evident that both alkaline treatments are leading to refine oils showing the same phosphorus, silicon and chlorine contents.

It must however be stressed that the pure potassium hydroxide required to achieve this result is 7.2 wt % i.e. 45 times the (TAN+SN) stoechiometry if a 50 wt % aqueous solution is used, but is only 0.47 wt % i.e. 3 times the stoechiometry when the eutectic was used.

It must be further added that, in that latter case, the reaction temperature was only 220° C. instead of 300° C.

These two examples clearly establish a much higher reactivity of the potassium hydroxide/water eutectic (86.7/13.3).

TABLE V

| | Operating conditions | | | | Results (mg/kg) | | |
|---|---|---|---|---|---|---|---|
| | Temp | Time | KOH aqu. | KOH | | | |
| Examples | ° C. | mn | sol | (dry) | P | Si | Cl |
| 1 | 300 | 30 | 50 | 7.2 | 1 | <1 | 16 |
| 2 | 220 | 30 | 86.7 | 0.47 | 1 | <1 | 16 |

EXAMPLES 3 TO 11

Using the same initial distillate fraction and the same operating procedure, as described in the above examples step (b) of the alkaline treatment of the process according to the invention was performed at various temperatures between 175° C. and 300° C., during a period of time between 10 and 60 minutes, using n-octanol as solvent, according to the conditions described in Table VI below.

The amount of alkaline reactant used was, in all cases at least equivalent to twice the (TAN+SN) stoechiometry and all tests were formed under atmospheric pressure, except examples 10 and 11 performed under a pressure of $10\times10^5$ Pa.

It results from Table VI that, at the same temperature, potassium hydroxide give rise to very satisfactory results in reducing the phosphorus, silicon and chlorine contents.

TABLE VI

| | Temperature | mn Time | ALCOHOL | | ALKALINE REACTANT | | RESULTS (mg/kg) | | |
|---|---|---|---|---|---|---|---|---|---|
| Ex | ° C. | mn | Type | Mass % | NaOH (pure) | KOH (pure) | P | Si | Cl |
| 3 | 175 | 10 | n-$C_8H_{17}OH$ | 4.4 | — | 0.49 | 5 | 2 | 32 |
| 4 | 200 | 60 | n-$C_8H_{17}OH$ | 3.24 | — | 0.36 | 3 | <1 | 10 |
| 5 | 200 | 60 | n-$C_8H_{17}OH$ | 7.1 | — | 0.76 | 1 | <1 | 8 |
| 6 | 200 | 60 | n-$C_8H_{17}OH$ | 19.9 | — | 2.14 | 1 | <1 | 3 |
| 7 | 200 | 60 | n-$C_8H_{17}OH$ | 3.24 | 0.36 | — | 2 | <1 | 18 |
| 8 | 200 | 60 | n-$C_8H_{17}OH$ | 7.1 | 0.79 | — | 2 | <1 | 14 |
| 9 | 200 | 60 | n-$C_8H_{17}OH$ | 19.3 | 2.14 | — | 1 | <1 | 12 |
| 10 | 250 | 30 | n-$C_8H_{17}OH$ | 7.7 | — | 1.29 | 1 | <1 | 20 |
| 11 | 300 | 60 | n-$C_8H_{17}OH$ | 7.2 | — | 0.79 | 1 | 1 | 5 |

EXAMPLE 12

According to the procedure described above, a distillation was performed on used oils from various origins, leading to a distillate with the following characteristics:

| | |
|---|---|
| Chlorine content (mg/kg) | 72 |
| Phosphorus content (mg/kg) | 18 |
| Silicon content (mg/kg) | 23 |
| Colour (ASTM D 1500) | 7 |
| Total Acid Number (TAN; mg KOH/g) | 0.49 |
| Saponification Number (SN; mg KOH/g) | 2.90 |

One half of this distillate was processed with 2.5 wt % potassium hydroxide at 85 wt % concentration (i.e. 2 wt % dry potassium hydroxide), while the other half was processed with 4.71 wt % potassium hydroxide at 85 wt % concentration (i.e. 4 wt % dry potassium hydroxide). Both treatments were performed at 250° C. for about 30 minutes.

The first half, processed with 2 wt % dry potassium hydroxide, was divided in two equal parts.

The first one was subjected to one water washing with 10% water at 100° C. and the second one to the following two water washing operations:

1) a first washing with 5% water at 65° C., and after settling; to 2) a second washing with 5% water at 100° C.

In a similar way, the second half, processed with 4 wt % dry potassium hydroxide, was divided in two equal parts.

The first one was subjected to one water washing with 10% water at 100° C. and the second one to the following two water washing operations:

1) a first washing with 5% water at 65° C., and after settling; to 2) second wash with 5% water at 100° C.

After settling, each of the four oil phases collected was vacuum fractionated under a pressure of 1300 Pa in order to obtain for each oil phase the following four fractions.

| | |
|---|---|
| Fraction I | 264° C.–370° C. |
| Fraction II | 370° C.–441° C. |
| Fraction III | 441° C.–475° C. |
| Fraction IV | 475° C.–558° C. |

Colour determination of the above fractions was then carried out according to ASTM D 1500 and the corresponding results are summarized in the following Table VII:

TABLE VII

| Dry KOH (wt %) | | 2% | | | | 4% | | | |
|---|---|---|---|---|---|---|---|---|---|
| Fractions | | I | II | III | IV | I | II | III | IV |
| Water Washing | One step | 2.1 | 1.5 | <2.5 | <3.5 | 1.5 | <3 | <4 | <6 |
| | Two steps | <1.5 | <1.5 | <1.5 | <3.5 | <1 | <1 | <1.5 | 3.5 |

These data are clearly showing that the two steps water washing technique does lead to refined oils with superior colour characteristics, a result which was totally unexpected.

In addition, it has been determined that in order to maximize the oil phase yields prior to distillation, it was suitable, in the process involving two washing steps, to use for the first water washing a water amount superior or equal to 2% but inferior or equal to 10%, and preferably between about 4% and 6% which would warrant yields between 90% and 98%.

I claim:

1. A process for refining used oils containing various contaminants comprising the following sequence of steps consisting of:

(a) fractionally distilling used oils and recovering a major fraction of the distillate, said distilling being first performed under atmospheric pressure at a temperature between about 130° C. and 180° C. and then under reduced pressure of about 650 to 12,000 Pa and at a temperature between about 240° C. and 345° C., (b) contacting the major fraction of the distillate with an alkaline reactant selected from the group consisting of sodium hydroxide and potassium hydroxide in the presence of a solvent selected from water, monoalcohols, polyalcohols and a mixture thereof, the proportion of sodium hydroxide or potassium hydroxide used being in weight percent to the weight percent of the major fraction of the distillate equal to F×(TAN+SN), F being a multiplying factor between 2 and 50, TAN and SN being respectively the Total Acid Number and Saponification Number of the distillate, said contacting being carried out at a temperature between 80° C. and 330° C. for a time between 2 and 200 minutes, (c) washing the product of step (b) with 1 to 15% water, followed by settling to recover an oil phase, and (d) fractionally distilling said oil phase under vacuum of about 650 to 1,350 Pa and at a temperature between 210° C. and 375° C., in order to recover the refined oil fraction.

2. The process according to claim 1, wherein step (c) is performed at a temperature in the range of ambient temperature to 100° C.

3. The process according to claim 1 wherein the alkaline reactant is potassium hydroxide.

4. The process according to claim 1 wherein the solvent is water and the alkaline reactant concentration is comprised between 50% and 96% wt based to the weight of the aqueous solution.

5. The process according to claim 1 wherein the alkaline reactant is in the form of potassium hydroxide/water eutectic (86.7/13.3).

6. The process according to claim 1 wherein the solvent is selected from monoalcohols, polyalcohols or a mixture thereof, the alcoholic alkaline solution being such that the mole ratio between the monoalcohol or the polyalcohol to the alkaline reactant is between 2 and 20.

7. The process according to claim 6 wherein the mole ratio between the monoalcohol or the polyalcohol to the alkaline reactant is between 2.5 and 5.

8. The process according to claim 1 wherein the monoalcohol or the polyalcohol contains 2 to 8 carbon atoms.

9. The process according to any of the above claims wherein step (c) of water washing is performed in two separate steps, the first one using 1% to 10% water at a temperature between 20° C. and 90° C., and the second one involving, after settling, 1% to 10% water at high temperature as high as possible and at least equal to the temperature of the first step.

10. The process according to claim 9 wherein the second washing step is performed with a weak acidic aqueous solution.

11. The process according to claim 1 wherein the oil phase collected from the washing step (c) is further processed by at least one of the following processes: high pressure catalytic hydrogenation, reaction with a sulfonating agent or contacting with activated carbon or clay.

12. The process according to claim 11 wherein the sulfonating agent is either concentrated sulfuric acid or chlorosulfonic acid.

13. The process according to claim 11 wherein the activated clay is an acid treated silicoaluminate.

14. The process according to claim 11 wherein the oil phase after being reacted with a sulfonating agent is then neutralized.

15. The process according to claim 14 wherein the oil phase is neutralized by an aqueous ammonia solution.

* * * * *